US012262819B2

(12) United States Patent
Fritze

(10) Patent No.: US 12,262,819 B2
(45) **Date of Patent: *Apr. 1, 2025**

(54) MODULAR CHAIR

(71) Applicant: DV8 ID S.R.L., Milan (IT)

(72) Inventor: Torsten Fritze, Cernobbio (IT)

(73) Assignee: DV8 ID S.R.L., Milan (IT)

( * ) Notice: Subject to any disclaimer, the term of this patent is extended or adjusted under 35 U.S.C. 154(b) by 0 days.

This patent is subject to a terminal disclaimer.

(21) Appl. No.: 18/432,143

(22) Filed: Feb. 5, 2024

(65) Prior Publication Data

US 2024/0172871 A1 May 30, 2024

Related U.S. Application Data

(63) Continuation of application No. 17/297,681, filed as application No. PCT/IB2019/060333 on Nov. 29, 2019, now Pat. No. 11,918,125.

(30) Foreign Application Priority Data

Dec. 5, 2018 (IT) ..... 102018000010836

(51) Int. Cl.
*A47C 5/06* (2006.01)
*A47C 4/02* (2006.01)
(Continued)

(52) U.S. Cl.
CPC ..... *A47C 5/10* (2013.01); *A47C 4/028* (2013.01); *A47C 4/30* (2013.01); *A47C 4/46* (2013.01); *A47C 13/005* (2013.01)

(58) Field of Classification Search
CPC .. A47C 5/06; A47C 5/10; A47C 4/028; A47C 4/30; A47C 4/283; A47C 4/42; A47C 31/023
(Continued)

(56) References Cited

U.S. PATENT DOCUMENTS 1,409,746 A 3/1922 McCord
2,209,145 A 7/1940 Weber
(Continued)

FOREIGN PATENT DOCUMENTS

JP S543213 U 1/1979

OTHER PUBLICATIONS

The International Search Report and Written Opinion, mailed Jan. 17, 2020.

*Primary Examiner* — Robert Canfield
(74) *Attorney, Agent, or Firm* — Vorys, Sater, Seymour and Pease LLP

(57) ABSTRACT

A modular chair including a support portion to allow the support of a user on it and including a frame and a fabric. The fabric defines a surface suitable to support the user and a perimetral area defined by the edges of the surface. The frame defines, in use, a closed profile and is suitable to support the fabric in tension along at least part of the perimetral area, and comprises at least two parts separate and reciprocally loosely connected by two hinges arranged respectively at the ends of said parts to define a configuration of use in which the parts form the frame and a configuration of rest in which the parts are folded together. The hinges define two respective axes of rotation mutually aligned. The frame tensions the fabric only when the parts are in the configuration of use.

24 Claims, 7 Drawing Sheets

(51) Int. Cl.

| | |
|---|---|
| ***A47C 4/30*** | (2006.01) |
| ***A47C 4/46*** | (2006.01) |
| ***A47C 5/10*** | (2006.01) |
| ***A47C 13/00*** | (2006.01) |

(58) Field of Classification Search
USPC ..... 297/16.1, 45, 218.4, 218.5, 351, 440.11, 297/440.14, 452.13, 452.2
See application file for complete search history.

(56) References Cited

U.S. PATENT DOCUMENTS

| | | | | |
|---|---|---|---|---|
| 2,735,480 | A | 2/1956 | Mead | |
| 2,839,126 | A | 6/1958 | O'Neill | |
| 3,061,374 | A | 10/1962 | Grosfillex | |
| 3,589,715 | A | 6/1971 | Mark | |
| 3,708,204 | A * | 1/1973 | Wachsmann | A47C 4/03 108/156 |
| 3,730,584 | A * | 5/1973 | Uchida | A47C 4/283 248/436 |
| 4,252,371 | A | 2/1981 | Lehnen | |
| 4,393,529 | A | 7/1983 | Britz | |
| 4,693,512 | A | 9/1987 | Hobson | |
| 4,842,335 | A | 6/1989 | Wunderlich | |
| 5,320,404 | A | 6/1994 | Le Gal | |
| 5,536,063 | A * | 7/1996 | Cable | A47C 4/02 297/440.16 |
| 5,762,403 | A | 6/1998 | Robinson | |
| 5,931,526 | A | 8/1999 | Tseng | |
| 6,293,624 | B1 | 9/2001 | Gaylord et al. | |
| 6,370,714 | B1 | 4/2002 | Elzenbeck | |
| 7,192,091 | B1 * | 3/2007 | Ping Sheng | A47C 4/32 297/452.2 |
| 10,182,655 | B1 * | 1/2019 | Frankel | A47C 4/283 |
| 2005/0120522 | A1 * | 6/2005 | Church | B62B 9/10 24/265 R |
| 2009/0224592 | A1 | 9/2009 | Chen et al. | |
| 2010/0109414 | A1 | 5/2010 | Chiang | |
| 2011/0233984 | A1 | 9/2011 | Lee | |
| 2015/0308171 | A1 | 10/2015 | Shadley | |
| 2019/0335915 | A1 | 11/2019 | Wang | |
| 2022/0287476 | A1 | 9/2022 | Fritze | |

* cited by examiner

*Fig. 3*
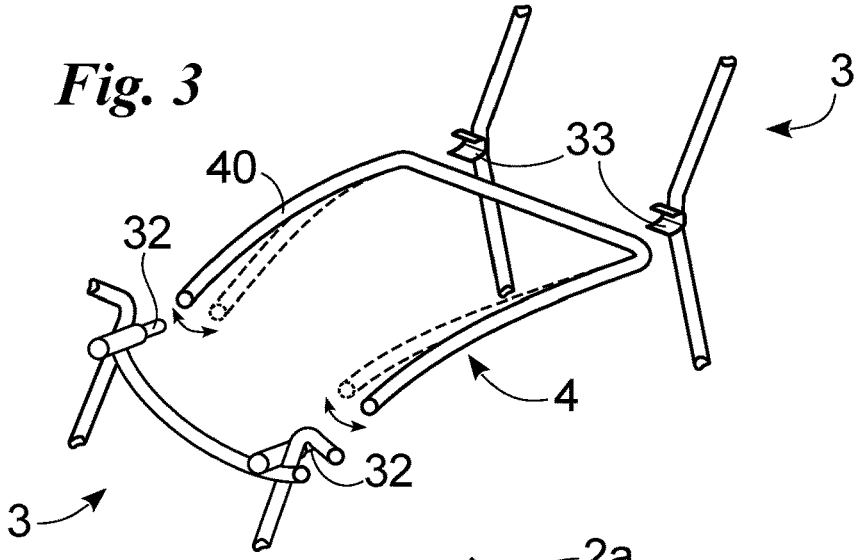
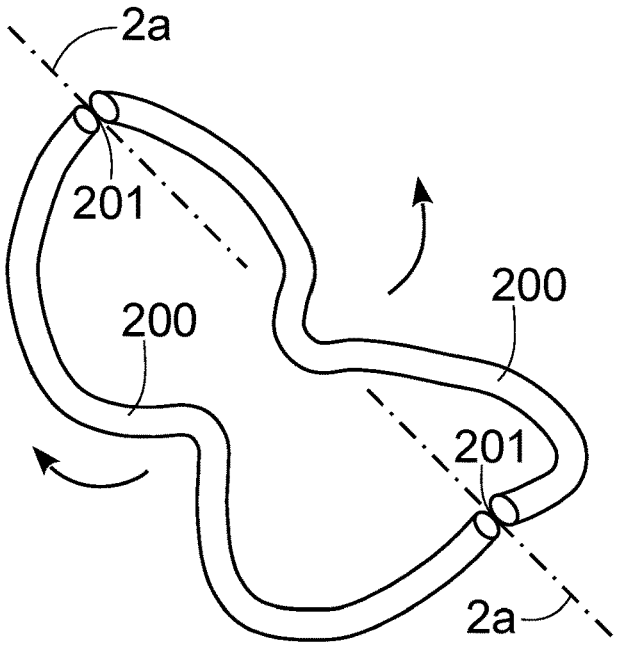
*Fig. 4*
*Fig. 5a*
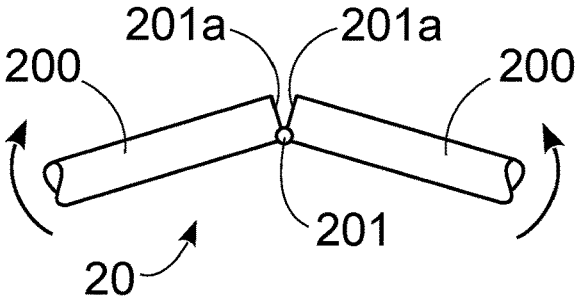
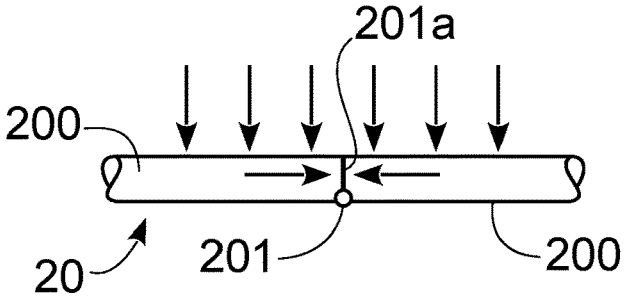
*Fig. 5b*

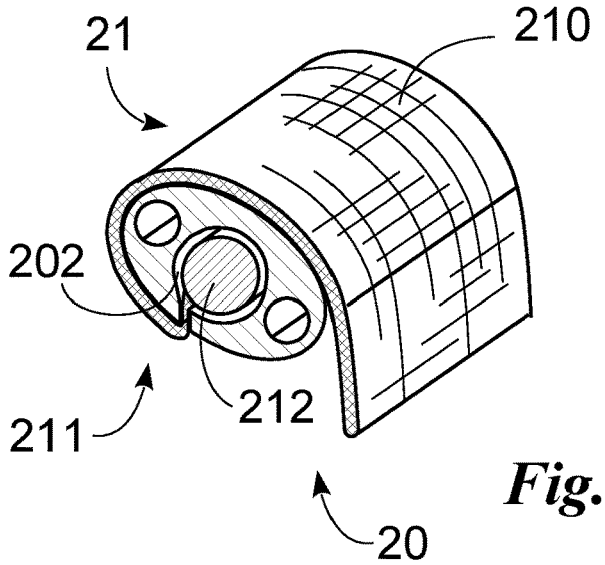
*Fig. 6*
*Fig. 7*
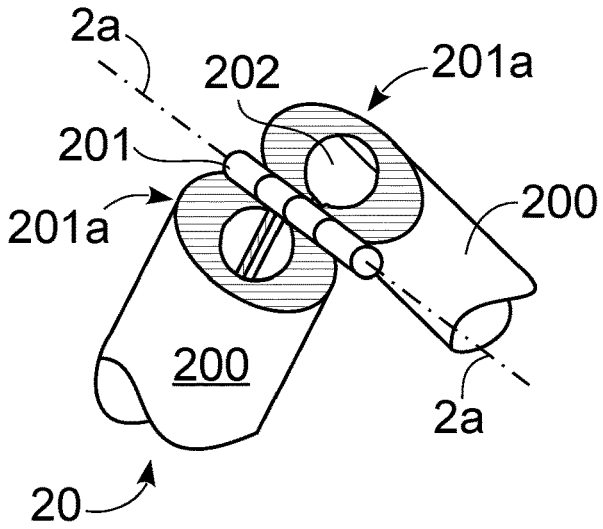
*Fig. 8*
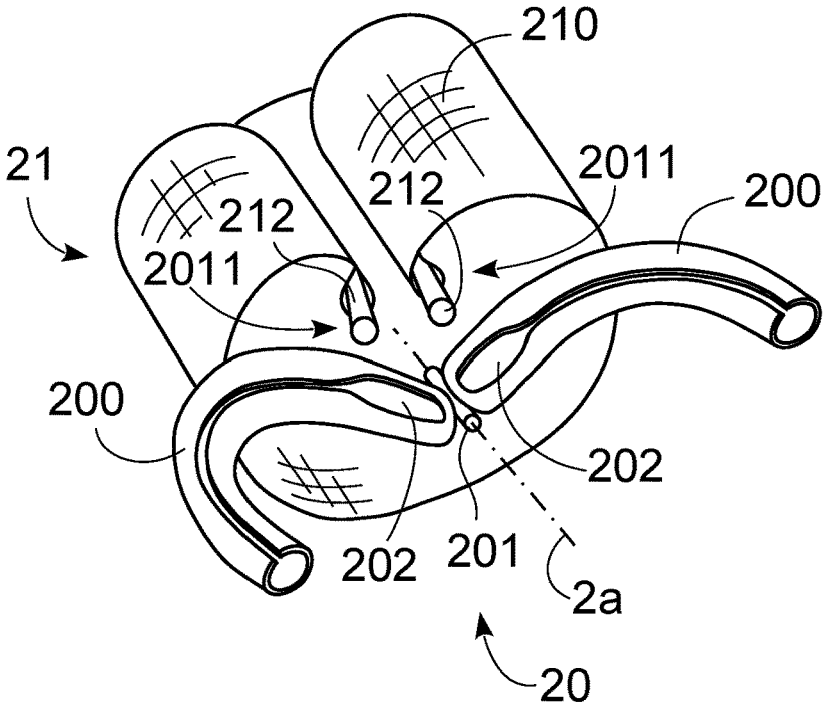

*Fig. 13a*
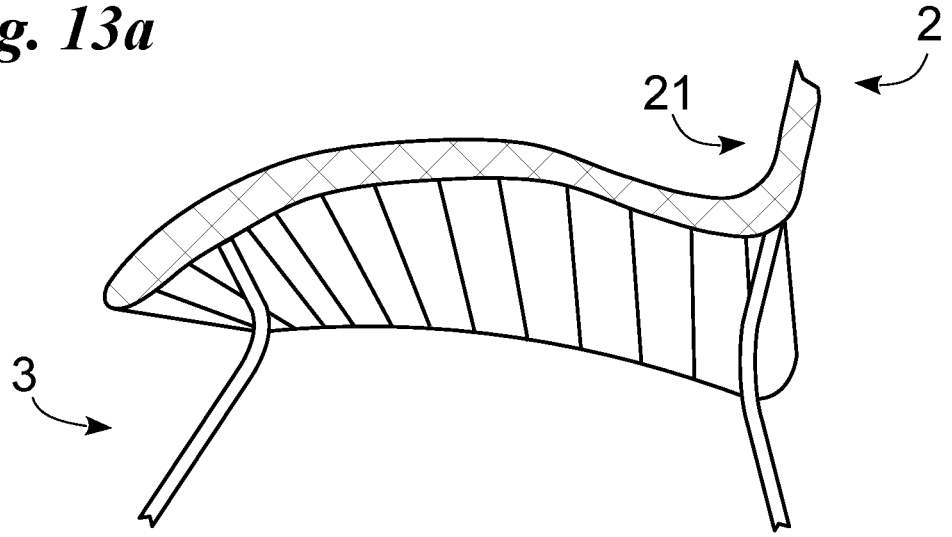
*Fig. 13b*
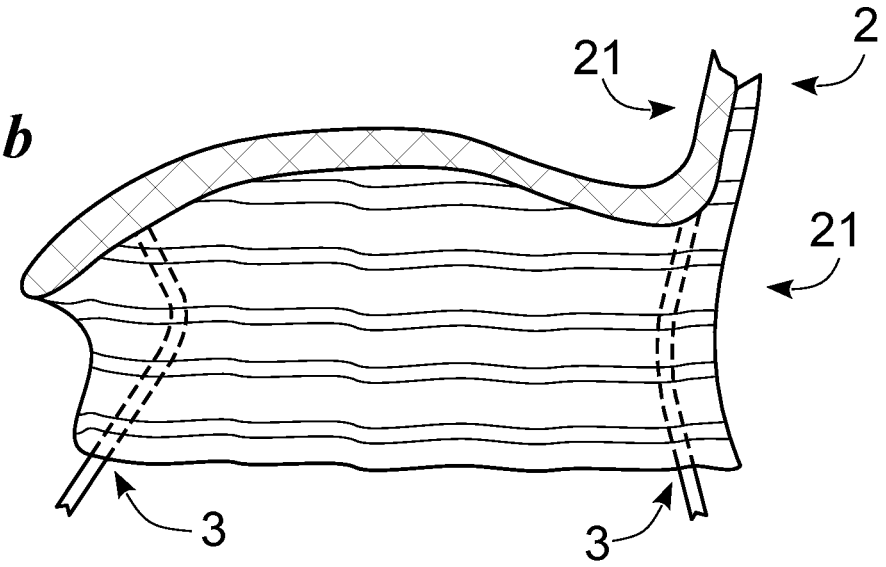
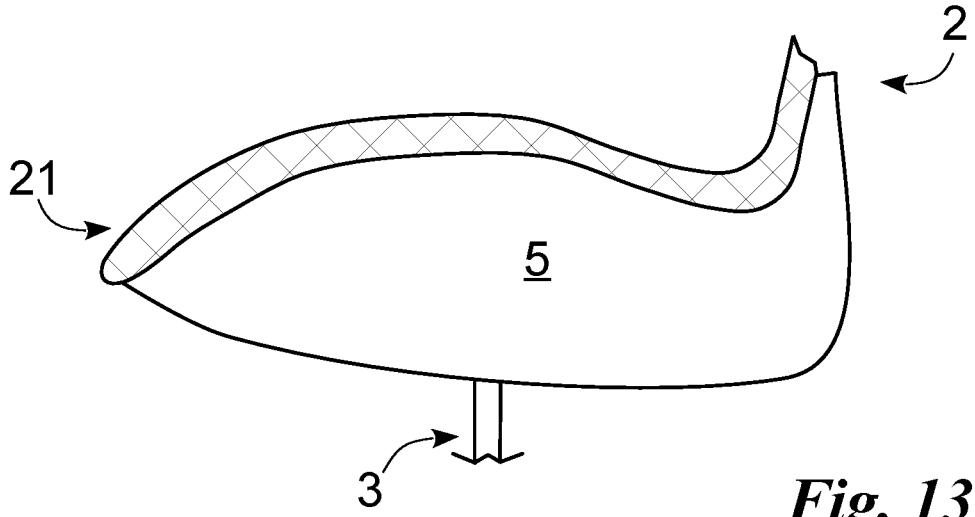
*Fig. 13c*

MODULAR CHAIR

CROSS-REFERENCE TO RELATED APPLICATIONS

This is a continuation application of U.S. patent application Ser. No. 17/297,681, filed May 27, 2021, which is a § 371 National Stage Application of International Application No. PCT/IB2019/060333 filed on Nov. 29, 2019, incorporated herein by reference, claiming the priority of Italian Patent Application No. 102018000010836 filed on Dec. 5, 2018.

FIELD OF THE INVENTION

The present invention relates to a modular chair.

In particular, this invention relates to a modular chair, in the broadest sense of the term, namely any device that allows the seating of a user and which may, depending on the configuration, consist of a chair, an armchair, a sofa or otherwise for various types of application including the office, home, garden, luxury and so on.

BACKGROUND OF THE INVENTION

As is well known, in the present state of the art, many different types of chairs have been produced, for example with armrests, recliners, slings, or armchairs or sofas and so on, according to the reference market for which the chairs are intended. Historically, chairs are derived from simple benches. The latter are in fact equipped with a simple support surface defining the seat structurally connected to at least two support pillars to allow the seat to be raised from the floor.

Currently, chairs are typically designed to allow the support of at least one user, and preferably one, on a plane called a seat. Most chairs also have additional support elements, such as the backrest, and may also comprise armrests and supports for the support of the upper and lower limbs respectively.

Among the various widespread types of chairs are the so-called deck chair, consisting of a folding chaise longue the backrest of which can be reclined at variable angles and on which a sitting or lying position may be taken, as desired by the user, the curule seat, also developed as the faldstool, with a substantially crossed, or X structure, and sometimes folding for the support of the seat, the tripolina entirely folding and used historically in battlefields, the monobloc chair generally made of polymeric material and used for outdoor environments, mainly in the restaurant industry, the rocking chair comprising two curved supports designed to allow the rocking movement typical of the chair in question, and the cantilever chair, very commonly used and comprising only two uprights bent at floor level and at seat level and connected horizontally by a continuous tube.

In addition to the above examples are a number of other different types and structures of chair designed to meet aesthetic needs, such as the market demand for a certain shape, or technical needs, resulting for example from the need to optimize the production process while maintaining high quality levels of the chair product.

Examples of this type are described in patent applications U.S. Pat. Nos. 2,839,126 and 5,762,403 and 6,293,624 and US2010109414A1.

The chairs described in the above patent applications have such features and configurations as to allow the assembly of the chair starting from mutually engaging elements.

In particular, all the chairs provide the possibility to adapt a finished piece of fabric to a portion of the frame of the chair in such a way as to produce parts of it such as the seat and/or backrest.

In detail, all the solutions mentioned above have a perforated frame inside which a peripheral portion of fabric or strip of fabric can be introduced in such a way as to hook onto it. The attachment mechanism requires, in particular, that a slider trapped in the fabric is inserted into a guide.

The prior art described has several significant drawbacks.

In particular, all the chairs described require very long construction times. In fact, in all cases the frame and the components are made ad hoc and have very complex coupling mechanisms.

In this case, the tensioning of the covering fabrics can be very complicated and lead to breakage of the base frame or the fabrics. In other cases, this aspect also contributes to increasing the assembly time of the chair.

Almost all of the specimens described also have considerable dimensions due to the fact that all the components must be made in advance and then stored in a specific space.

It is no coincidence that a very significant problem for manufacturers of chairs or similar furniture is the supply of the parts composing them.

When, in fact, the chairs are made of various materials from various manufacturers, it can be complex, in the absence of storage space, to coordinate procurement so as to get all the components in a short time.

SUMMARY OF THE INVENTION

In this situation the technical purpose of the present invention is to devise a modular chair able to substantially overcome at least some of the drawbacks mentioned.

In the context of said technical purpose, one important object of the invention is to provide a modular chair that can be made easily and quickly.

Another important purpose of the invention is to make a modular chair that is also easy and fast to make, especially with regard to the supply of the parts composing it.

The technical purpose and specified aims are achieved by a modular chair of the invention.

Preferred technical embodiments are also described herein.

BRIEF DESCRIPTION OF THE DRAWINGS

The characteristics and advantages of the invention are clearly evident from the following detailed description of preferred embodiments thereof, with reference to the accompanying drawings, in which:

FIG. 3 is the detail of the stretcher and the support portion of a chair according to the invention;

FIG. 4 is a schematic view in perspective of the frame of a chair according to the invention;

FIG. 5*a* shows the detail of the mechanism made by the hinge of the frame of a chair according to the invention in the rest or pre-assembly configuration;

FIG. 5*b* shows the detail of the mechanism made by the hinge of the frame of a chair according to the invention in the configuration of use or in the assembled configuration;

FIG. 6 is a cross-section view of the frame of a chair according to the invention with a guide;

FIG. 7 shows the detail of the hinge of a chair according to the invention;

FIG. 8 shows a schematic example of introducing the fabric sliders into the frame guide of a chair according to the invention;

FIG. 13*a* is a detailed side view of a chair according to the invention in the preferred embodiment shown in FIGS. 1-2;

FIG. 13*b* is a detailed side view of a chair according to the invention in the alternative embodiment shown in FIGS. 9*a* and 10;

FIG. 13*c* shows a detailed side view of a chair according to the invention in the alternative embodiment shown in FIGS. 9*b* and 11;

DETAILED DESCRIPTION OF EMBODIMENTS OF THE INVENTION

Figure 1:
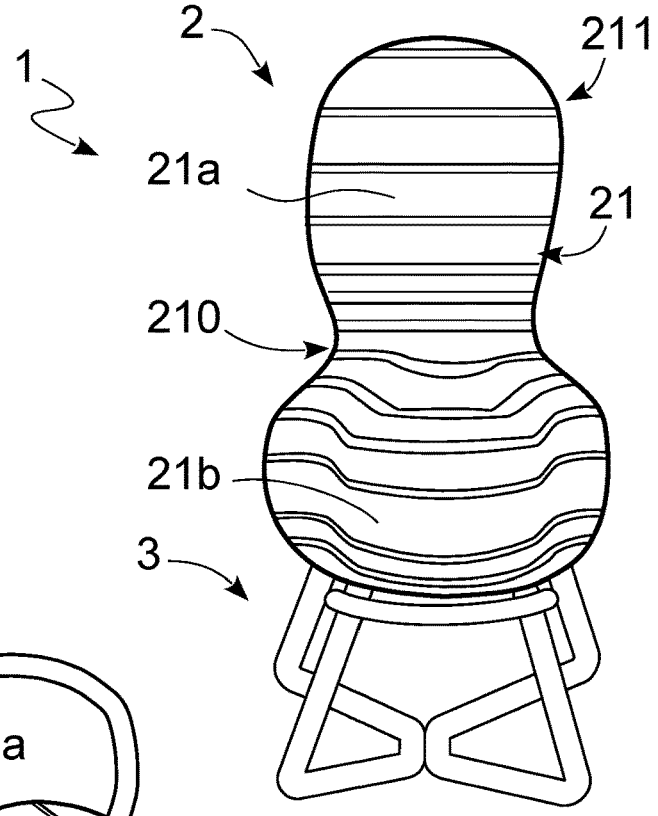
FIG. 1 shows a front view of a chair according to the invention.

In this document, the measures, values, shapes, and geometric references (such as perpendicularity and parallelism), when associated with words like "about" or other similar terms such as "approximately" or "substantially", are to be understood as except for measurement errors or inaccuracies owing to production and/or manufacturing errors and, above all, except for a slight divergence from the value, measure, shape, or geometric reference with which it is associated. For example, said terms, if associated with a value, preferably indicate a divergence of not more than 10% of said value.

In addition, where used terms such as "first", "second", "upper", "lower", "main" and "secondary" do not necessarily refer to an order, a priority relationship or relative position, but may simply be used to more clearly distinguish different components from each other.

The measurements and data presented herein are to be considered, unless otherwise indicated, as made in Standard International Atmospheres ICAO (ISO 2533: 1975).

With reference to the Drawings, reference numeral 1 globally denotes the modular chair according to the invention.

The modular chair 1 is preferably a chair, however it could be any device that allows a user to sit and that can, depending on the configuration, be constituted, therefore, also by devices other than a chair such as an armchair or a sofa.

For example, the chair 1 may also be a seat for a vehicle or other means of transport such as trains or aircraft.

In addition, the chair 1 is not constrained to a specific use and design, but can be adapted, as convenient, to uses of various kinds such as home use, in the office or in other environments other than those mentioned.

The chair 1 preferably comprises at least a support portion 2.

The support portion 2 is preferably suitable to allow a user to rest on it. Therefore, it is substantially the part of the chair 1 that can accommodate at least part of the user's body.

Preferably, the support portion 2 includes then a frame 20 and a fabric 21.

The fabric 21 may be defined by a sheet of fibre only, or it can also include padding elements, for example trapped between two strips of fabric.

Preferably, in any case, the fabric 21 defines a surface 210 and a perimetral area 211.

The surface 210 is preferably suitable to support the user. Therefore, preferably, it defines the support surface for said user and is suitable to support the weight force of the user.

The perimetral area 211 is instead substantially defined by the edges of the surface 210. In other words, the perimetral area 211 is substantially defined by the boundary zone of the surface 210.

Preferably, the fabric 21 includes composite fibres, i.e. polymeric filaments around which fabric filaments are twisted. This type of fibre allows the fabric to be reinforced or, more generally, the local mechanical properties of the fabric 21 to be modified at will. The term "local properties" means that the surface 210 can be considered as a set of smaller surfaces each defining its own mechanical properties and which can, therefore, vary from surface to surface.

In substance, the conformation of the fabric 21 can be achieved by means of studies and processes such as, for example, finite element theory or other types of methods allowing the surface to be discretized and the local mechanical properties of the discretized elements to be controlled.

Preferably, the fabric 21 is made by automated knitting machines and in particular by machines known as flat bed knitting machines.

With these machines it is possible, as already mentioned, to control the mechanical properties of the discrete elements of the surface 210 in such a way as to allow the fabric 21 to get the desired characteristics according to the structural elements interacting with it in the chair 1.

The fabric 21 can also be made with conventional weaving machines.

In this case, for example, the fabric 21 may show different mechanical properties within the surface 210, for example, depending on the thread count or texture adopted within the fabric 21.

The fabric 21 may also, whether it is made with computerised technology or with conventional textile technology, include localised support elements. For example, the fabric 21 may include within it metal structures, such as bars or filaments, trapped or woven inside pockets that can be easily made in the fabric 21, so as to locally increase the rigidity of the surface 210. In this sense, the fabric 21 may appear as a woven surface 210 including ribs or diaphragms, e.g. metallic, suitable to reinforce the structure of said fabric 21.

Preferably, the frame 20 defines, in use or, in other words, when assembled, a closed structure. As a result, the frame 20 extends along a curved trajectory in such a way as to close on itself and form a hole, as is the case with a ring.

Figure 2:
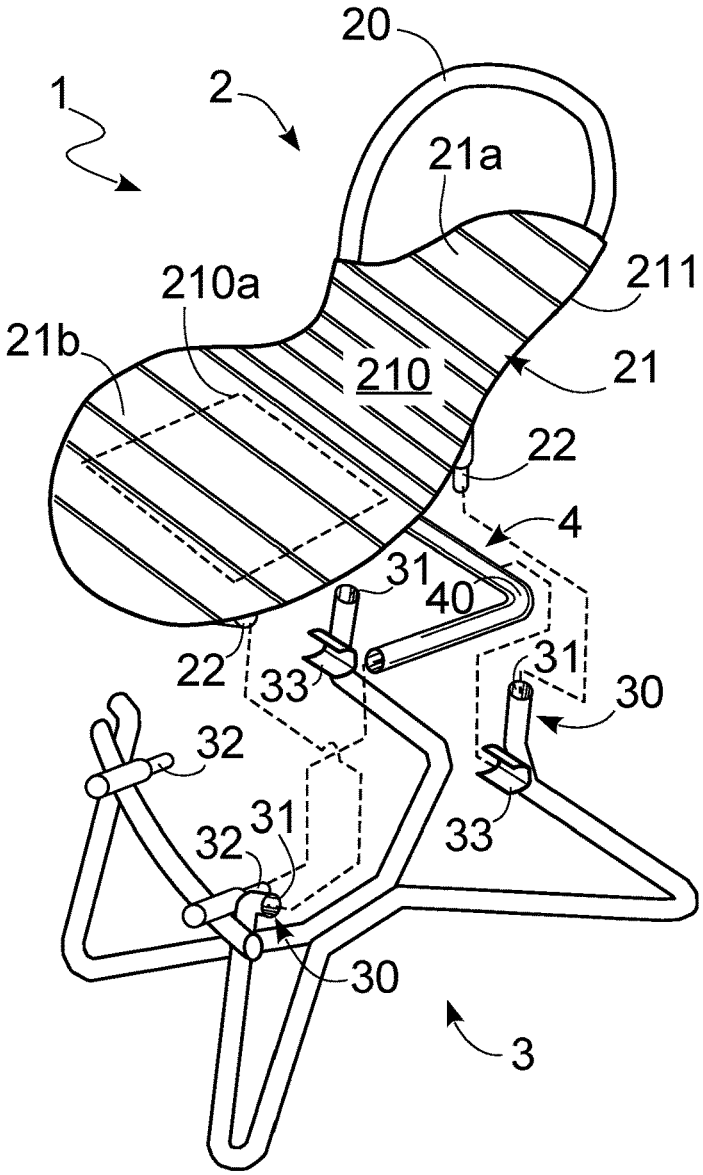
FIG. 2 shows an exploded view of a chair according to the invention.

The frame 20 does not necessarily have a structure formed of planar portions, but preferably has a complex structure that extends in space in a three-dimensional manner, as shown in particular in FIGS. 2, 4 and 8.

A complex structure of this type is, for example, a composite 3D curve, i.e. a curve made along a trajectory that rotates around at least two main axes in three-dimensional space.

Preferably, the frame 20 defines a condition of use or assembly configuration in which it creates the closed structure and a rest condition or pre-assembly configuration in which it takes a different shape.

In use or in the assembled configuration, the frame 20 is preferably suitable to support the fabric 21 under tension in correspondence of at least part of the perimetral area 211.

Figure 12:
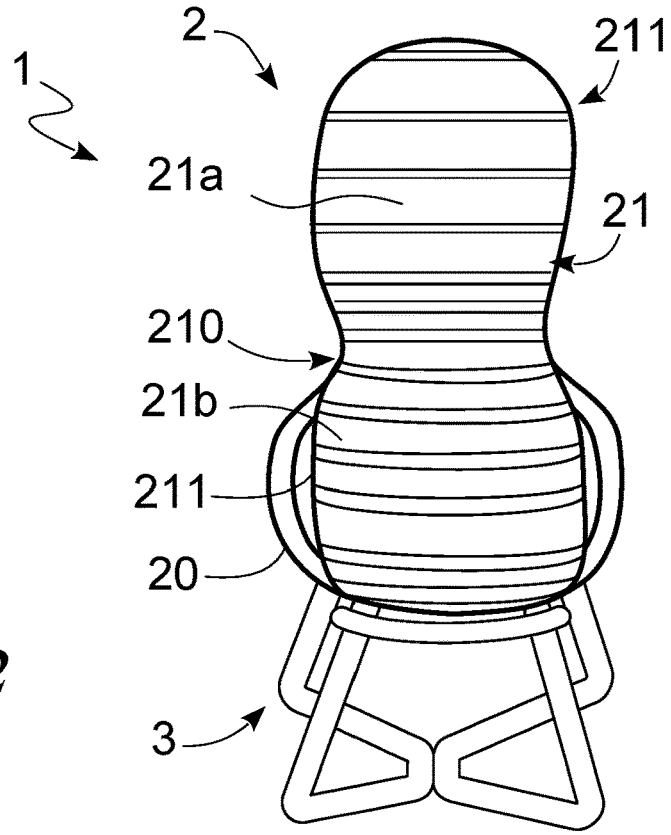
FIG. 12 shows a front view of a chair according to the invention including in an alternative embodiment in which the fabric is suspended.
Figure 14A:
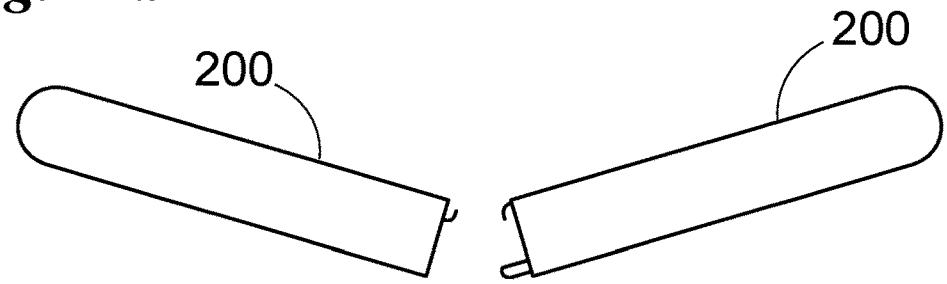
FIG. 14*a* shows a side view of a chair according to the invention in an alternative embodiment in which the parts are separate and distinct, when the chair is in a configuration unrelated to the configurations of rest or use, and are configured to be assembled together by a machine.
Figure 14B:
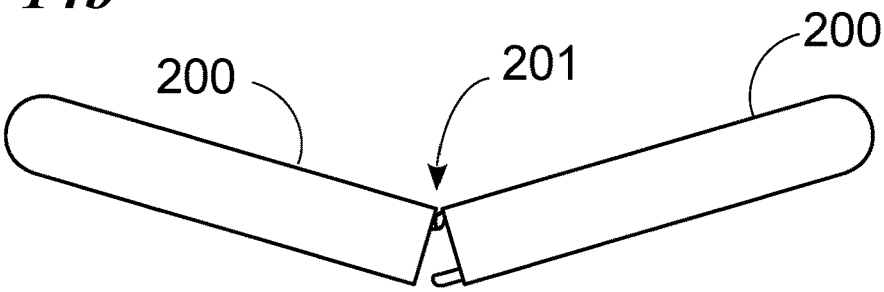
FIG. 14*b* is a side view of the chair in FIG. 14*a* in which the parts are arranged in a rest or assembled configuration with each other in such a way as to define the hinges.
Figure 14C:
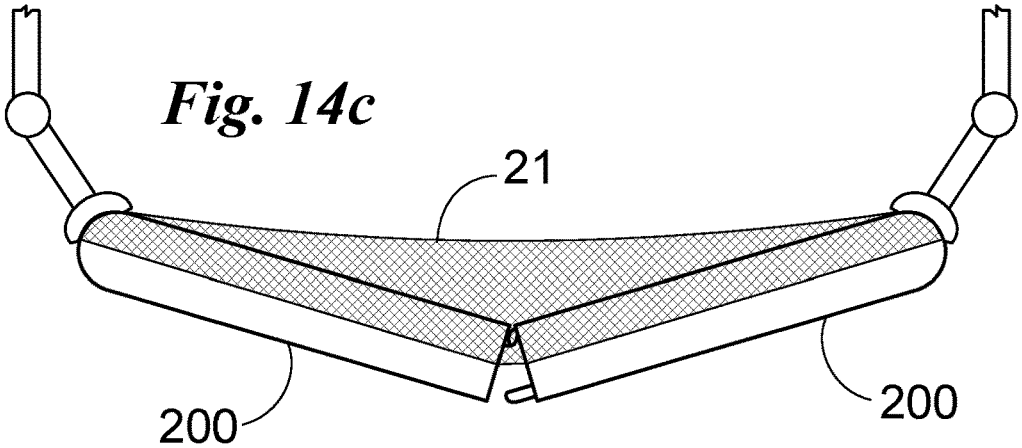
FIG. 14*c* shows a side view of the chair of FIGS. 14*a*-14*b* where the fabric is installed on the parts.
Figure 14D:
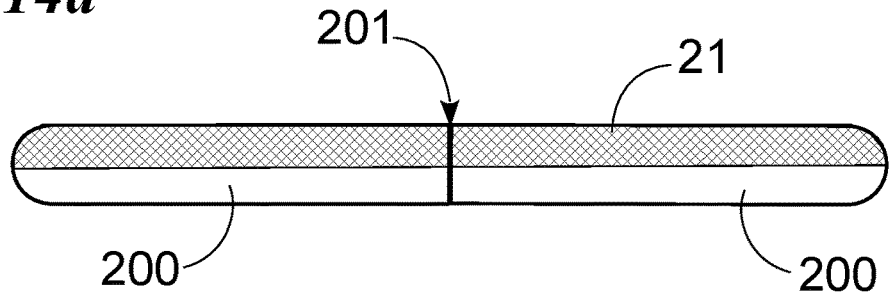
FIG. 14*d* shows a side view of the chair in FIGS. 14*a*-14*c* in which the parts are arranged in the configuration of use and make the frame by stretching the fabric installed therein.

The fabric 21 can in fact be fully connected to the frame 20 along its perimetral area 211 or can be only partially connected along its perimetral area 211, for example in the case of defining a chair 1 including part of the fabric 21 suspended, as shown in FIG. 12.

This last expedient may also be appropriate in the case of making the chair 1 with different fabrics 21. In fact, the chair 1 could comprise fabrics 21 partly connected to the frame 20 in the perimetral portions and partly connected to other fabrics to make the support portion 2.

In particular, the frame 20 locally tensions the fabric 21 in relation to the shape taken by said frame 20.

In the rest condition or pre-assembly configuration, instead, the frame 20 can release the fabric 21.

In order to achieve this, the frame 20 preferably, but not necessarily, comprises at least two parts 200.

The parts 200 are portions of frame 20 which may substantially coincide with sections of the closed structure defined by the frame 20. Preferably, they are mutually separate and mutually loosely connected at two fixed points. Alternatively, they can be parts of a single piece defining loose points between the parts 200 allowing the individual parts 200 to be identified. In the latter case, the fixed points correspond to the loose points. Preferably, these fixed points correspond to the endpoints of the parts 200, but other points, e.g. intermediate, may be provided so as to form annular shapes with irregular edges.

Preferably, the parts 200 are loosely connected to each other by means of two hinges 201.

The hinges 201 are preferably the means allowing the switching of the conditions or configurations of use (assembly) or rest (pre-assembly) of the parts 200 i.e. of the frame 20.

These hinges 201 are preferably mechanical.

In particular, preferably, the hinges 201 define the configuration of use, or assembly, in which the parts 200 actually form the frame 20 and the rest or pre-assembly configuration, in which the parts 200 are reciprocally folded together.

In this way, the overall dimensions of the support surface 2 are reduced when the parts 200, or the frame 20, are in the rest or pre-assembly configuration.

The hinges 201 may, therefore, connect the parts 200, in any configuration, for example in an embodiment suitable to allow the assembly of the chair 1 by an end user or user.

Or, the hinges 201 can be interpreted, in a broad sense, as connectors suitable to connect the parts 200 in each configuration and effectively connecting the parts 200 at least, and even just, in the configuration of use or just in the configurations of rest and use.

In this sense, it is meant that, in an embodiment in which the chair 1 is made industrially with ad hoc machinery, the parts 200 can be, not in the configuration of use, mutually separate and distinct and may comprise, each, protuberances or pins, at fixed points preferably corresponding to the ends of the parts 200, configured to provide the hinges 201 when mutually brought into contact, for example by the said machinery, at least in the configurations of rest and use. In this case, the protuberances substantially define supports suitable to define rotation points at fixed points. As a result, in this form, the hinges 201 could be provided, for example, even only in the step immediately prior to the definition of the configuration of use or the rest configuration.

In other words, the parts 200 define at least one configuration extraneous to the configurations of rest and use, and prior to these in the assembly step, where they are not in contact, while the hinges 201, made by placing the parts 200 in contact at the ends, would define an unstable rest configuration and a detachable connection stabilized for example only when parts 200 provide the frame 20 in the configuration of use.

In any case, preferably, the hinges 201 each define a rotation axis 2*a*. The rotation axis 2*a* lies preferably along the sagittal plane, which divides the closed structure into two substantially identical portions. In use, the sagittal plane contains appropriately the vertical direction.

The axis of rotation 2*a* preferably defines the only degree of freedom granted to the parts 200 of the frame 20. Therefore, in principle, the parts 200 are suitable to rotate preferably exclusively around the rotation axis 2*a* of the hinges 201.

Appropriately, the rotation axes 2*a* of the two hinges 201 are aligned with each other. As a result, the frame 20 can be substantially closed or folded, in the rest or pre-assembly configuration, and be reopened by identifying at least one configuration of use, or assembled configuration, corresponding to a stable equilibrium configuration in which the frame 20 tensions the fabric 21.

In particular, said frame 20 tensions the fabric 21 preferably only when the parts 200 are in a configuration of use.

In order to provide the configuration of use, or assembled or stable equilibrium configuration, the chair 1 according to the invention is preferably configured to allow mutual rotation of the parts 200 in one direction only. In particular, the reciprocal rotation permitted is preferably opposite to the ground, so as to allow the frame 20 to oppose a possible force weight of a weight or user placed on the support portion 2.

The term rotation opposite to the ground means that, when the 20 frame is opened like a book, it faces the ground in the same way as a book would allow its pages to face the ground, once opened.

In this sense, preferably, the chair 1 provides, in a first embodiment example, a particular configuration of the hinges 201.

In detail, and as shown in FIGS. 5*a*, 5*b* and 7, each of the hinges 201 includes interference portions 201*a*.

The interference portions 201*a* are preferably mutually interfering only when the parts 200 provide the frame 20 in the configuration of use. In addition, they are oriented in such a way that when the user is resting on the support surface 210, the interference portions 201*a* provide a mutual interference force proportional to the user's weight force.

In other words, the interference portions 201*a* may be shoulders suitable to collide when the frame 20 is in use and the parts 200 are placed in a position of stable equilibrium and the interference force may be the connecting reaction interacting between the interference portions 201*a* facing each other.

Appropriately, the parts 200 achieve the stable equilibrium position thanks to the interference portions 201*a*.

In a more complex configuration, the hinges 201 may not be mechanical hinges, for example such as domestic door hinges, but may be hinges 201 suitable to allow the looseness of the parts 200 with elastic deformation.

In this context, the parts 200, could even be, as already mentioned, part of a single piece closed and suitable to be folded in certain fixed loose points. Application examples such as these are present, for example, in bearing-less systems where the permitted movements of a hinge can be delegated to deformations of the material instead of to the mechanical connections of the structure.

In addition, the hinges 201 could also envisage locking means suitable to mutually lock the parts 200, when in the configuration of use or assembled, so as to ensure that they continue to keep the fabric 21 taut.

Alternatively, the hinges 201 may include an elastic element, such as a spring, to keep the parts 200 in the configuration of use or assembled, if not stressed. In the latter case, the locking devices could be configured to lock the parts 200, and therefore the frame, in the rest or pre-assembly configuration.

Or the interference portions 201*a* could, instead, themselves comprise locking means. For example, the latter could include a pressure lockable elastic mechanism suitable to block rotation around the hinge 201 as soon as the interference portions 201*a* collide. In addition, this mechanism could allow the release of the parts 200 and the release of the hinges 201 when pressed again. An example of this type could be a locking mechanism with a spring presser.

The fabric 21, as mentioned above, is connected to the frame 20 preferably along at least part of its perimetral area 211.

In particular, preferably, the frame 20 defines a guide 202.

The guide 202 is preferably a guide which is hollow and continuous at least along each of the parts 200. In particular, preferably, the guide 202 substantially takes the shape of a track through which elements, such as rigid elements, compatible with the dimensions of the guide 202, can pass.

Examples of this type are described, for example, in the U.S. Pat. No. 2,839,126 patent application, incorporated herein as reference, in column 1 lines 62-72 and column 2 lines 1-12.

In substance, the guide 202 may thus also include access holes that allow objects to be inserted inside said guide 202. These holes may be located, for example, in predetermined points of the frame 20 such as, for example, the fixed points at the ends of parts 200. Preferably, the access holes are located in the upper area of the frame 20 relative to the ground so that objects can be inserted from top to bottom, as shown in FIG. 8. Preferably, the access holes are facing the ground so as to be concealed from a user observing the chair 1 in the configuration in which it is to be used or assembled.

The fabric 21 then preferably includes at least one slider 212.

The slider 212 may be defined by a reinforced portion of fabric 21, or by a portion of fabric 21 of greater thickness and/or density, or it may be defined by an element external to the fabric 21 and attached to said fabric 21.

Preferably, in any case, the slider 212 is placed along the perimetral area 211 and is suitable to be inserted inside the guide 202.

Therefore, preferably, the guide 202 is suitable to allow the sliding of the slider 212 inside it. In detail, the guide 202 is configured to trap at least part of the slider 212 in order to bind the fabric 21 and the frame 20 together.

The slider 212 can therefore be made continuously along the perimetral area 211 of the fabric 21 or the fabric 21 can provide a plurality of consecutive sliders 212.

Preferably, the frame 20 is substantially a cornice for fabric 21 inside which the fabric can be placed by sliding of the slider 212 in the guide 202. A similar mechanism is also described in the patent application U.S. Pat. No. 6,293,624, incorporated herein as reference, in column 3 lines 26-52.

However, preferably, the guide 202 is accessible only from the bottom of chair 1, i.e. from the ground, and the fabric 21 is attached to the frame 20 in such a way as to wind around at least part of the frame 20.

In this way, not only is the connection between the frame 20 and the fabric 21 concealed from the user, but in addition the frame 20 itself is covered with the fabric 21 and the tension is further ensured by the winding of the fabric 21 around the frame 20.

The parts 200 may then be different, or they may be identical and mirror each other in relation to the axes of rotation 2*a*.

This last example is preferable especially so as to optimize the production of the parts 200. The latter are, in fact, preferably made of aluminium by means of three-dimensional extrusion. Obviously, the parts 200 could also be made of polymeric material, for example also extruded, or other materials allowing the creation of hollow and continuous profiles with a non coplanar extension path. In another type of embodiment, the parts 200, and therefore the frame 20, could be made using a composite structure, for example including a metal core covered with a different material, such as a polymeric material, for example by means of technologies such as polymer injection moulding on a metal core.

The non coplanar aspect however, remains an element which is not necessary, but preferable for making the chair 1, especially with regard to the comfort provided by it.

The chair 1 comprises, in addition to the support portion 2, also a load-bearing portion 3.

The load-bearing portion 3 is preferably designed to support the support portion 2 suspended and permanently spaced from the ground. For example, a typical load-bearing portion 3 included in conventional chairs is made up of four, or fewer, support legs.

Otherwise, but not necessarily, the load-bearing portion 3 is preferably made of a tubular structure that can be connected to the support portion 2. More generally, the load-bearing portion 3 includes attachment means 30.

The attachment means 30 are preferably suitable for detachably and stably connecting the support portion 2 and the load-bearing portion 3.

These attachment means 30 are preferably interlocking connections suitable to connect the portions 2, 3 in predetermined fixed points so as to make the chair 1. More specifically, the frame 20 includes protuberances 22.

The protuberances 22 preferably protrude towards the ground. The protuberances 22 are for example cylindrical elements which protrude from the frame 20 to interact with other external components.

These protuberances 22 are therefore preferably, in turn, connected to the frame 20 by means of known constraints such as nails, bolts or other types of joint. Alternatively, the protuberances 22 could be made directly on the frame 20.

The protuberances 22 may therefore be made of metallic or, preferably, polymeric material. For example, the protuberances 22 can be made using injection moulding technology.

The attachment means 30 are, then, suitably configured to interact with the protuberances 213. In particular, preferably, the attachment means 30 include holes 31 structurally configured to accommodate the protuberances 22 so as to permanently block the support portion 2 onto the load-bearing portion 3. In particular, preferably, the chair 1 is configured in such a way that the weight of the support portion 2 and, possibly, of a weight or user placed on it, tends to keep the support portion 2 and the load-bearing portion 3 connected to each other and permanently locked.

Figure 9A:
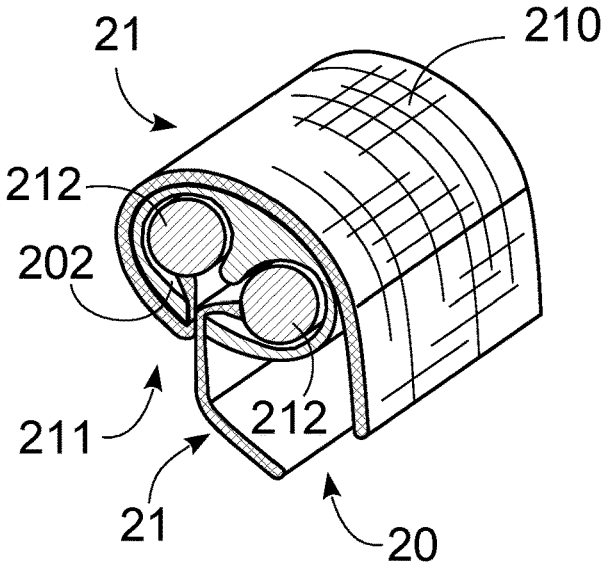
FIG. 9*a* shows a cross-section view of the frame of a chair according to the invention with two fabrics connected to the frame in a single guide.
Figure 9B:
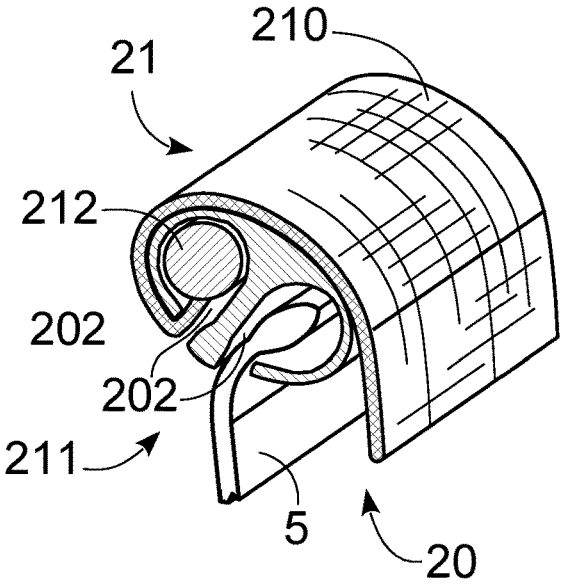
FIG. 9*b* is a cross-section view of the frame of a chair according to the invention with two guides, a fabric and a coupling device in which the fabric and the coupling device are each connected to the frame by means of a special guide.
Figure 10:
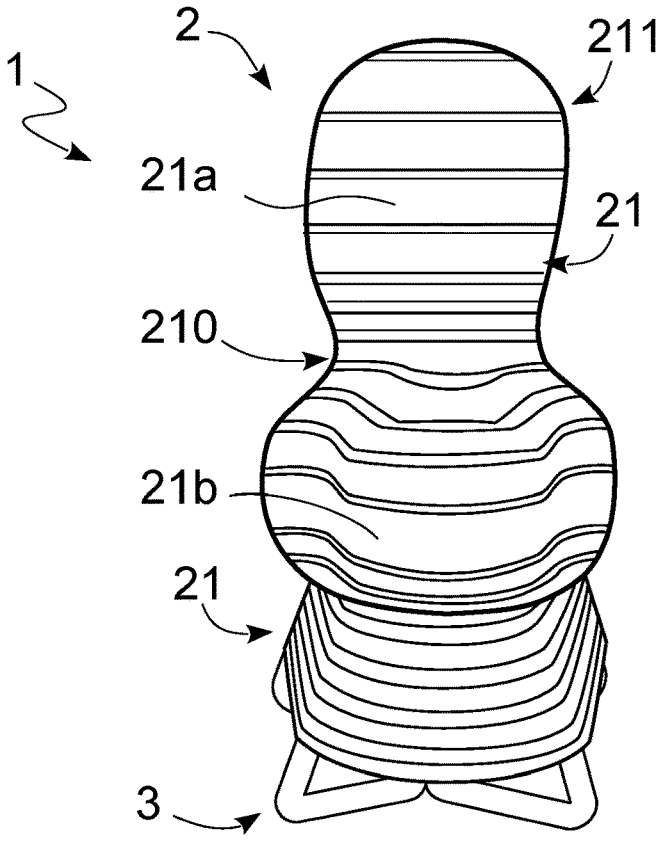
FIG. 10 is a front view of a chair according to the invention including a fabric covering the bottom of the support portion.

The load-bearing portion 3, as mentioned above, does not necessarily define a structure as described above, but may also include a conventional configuration, e.g. cantilevered, four-legged or other configuration, provided that it includes attachment means 30 suitable to allow the coupling of the support portion 2 and the load-bearing portion 3. In an alternative configuration of the chair 1, the parts 200 may comprise two guides 202 each, as shown in FIG. 9*b*. In this case, for example, the chair 1 can be configured in such a way as to trap two different fabrics 21, one of which can be used to make the support portion 2, and the other to cover the bottom of the chair, as explicitly shown in FIGS. 10 and 13*b*. The second guide 202 could also allow the connection, by interlocking, of a coupling device 5, as shown in FIGS. 9*b* and 13*c*.

Figure 11:
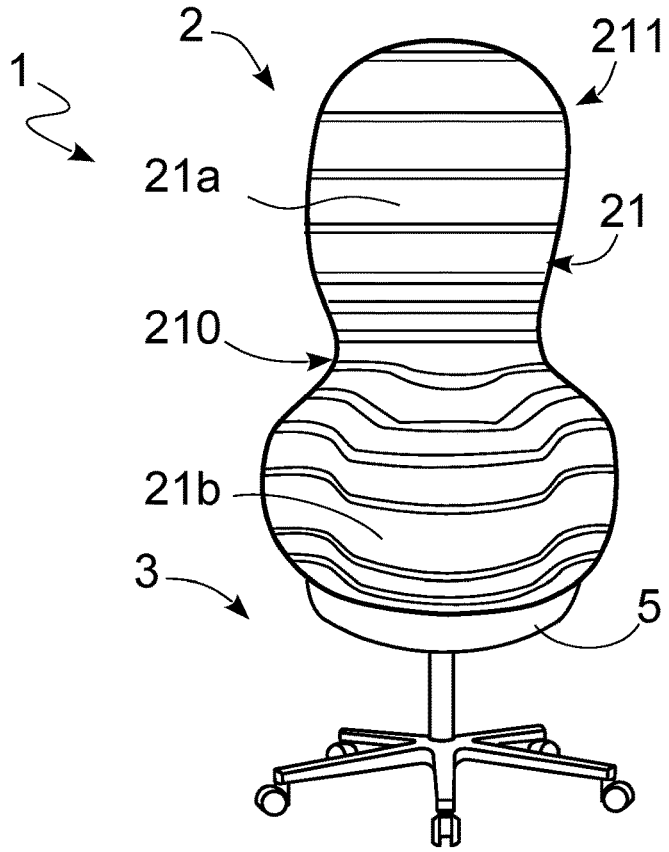
FIG. 11 shows a front view of a chair according to the invention including a coupling device at the bottom of the support portion and a support portion in an office embodiment.

The coupling device 5 could be, for example, a body provided on the bottom, in relation to the ground, of the support portion 2 in such a way as to support it, through the connection in the second guide 202, concealing part of the bottom of the chair 1, and allowing the connection of the support portion 2 to any type of load-bearing portion 3. In fact, the coupling device 5 could have its own rigidity, for example, given by the fact that it is made of a metal or polymer structure, such as to allow the coupling of the support portion 2 to the load-bearing portions 3 such as the wheel supports of typical office chairs, as shown in FIG. 11.

As a result, the coupling device 5 may be counter-shaped to the lower portion of the frame 20 and, in particular, may have an edge counter-shaped to the second guide 202 and may be counter-shaped to the final shape of the surface 210 of the fabric 21 of the support portion 2. Obviously, the coupling device 5 may include articulation mechanisms of the support portion 2 known in the state of the art. Mechanisms of this type are known, for example, by the term Synchro-tilt.

The chair 1 preferably comprises, in addition, a stretcher 4.

The stretcher 4 may be part of the load-bearing portion 3 and integrated inside it or it may be an external element.

Preferably, the stretcher 4 is configured to tension the support surface 210 along predetermined fixed points so that the fabric 21 defines at least two specific areas, or even more. Preferably the fabric 21, when stretched, defines a backrest 21*a* and a seat 21*b*.

The seat 21*b* is preferably placed adjacent to the support portion 3, while the backrest 21*a* is spaced from it and is suitable to accommodate the user's back. In particular, the stretcher 4 is capable of exerting a greater tension on the seat 21*b*.

The seat 21*b* therefore includes a 210 support surface that is more taut than, for example, the backrest.

The stretcher 4 preferably includes a tubular element 40.

The tubular element 40 can therefore be hollow or solid. Preferably it is U-shaped, or C-shaped, and is suitable to exert a tension on the support surface 210 along its extension.

The support surface 210 can thus be placed between the stretcher 4 and the ground so that the stretcher 4 tensions the fabric 21 directly towards the ground.

Preferably, the support surface 210 includes a pocket 210*a*.

The pocket 210*a* is preferably configured to accommodate at least part of the tubular element 40. In this way, the tubular element 40, when subjected to movements, moves part of the fabric 21 with it.

Depending on the shape of the pocket 210*a*, moreover, the fabric 21 is also only strained along the attachment points of the tubular element 40 to the pocket 210*a* or, if the pocket 210*a* completely covers the tubular element 40, the fabric 21 is strained along the entire extension of the tubular element 40.

In this configuration, preferably, the tubular element 40 is placed below the fabric 21 with respect to the ground, and inside the pocket 210*a* made on said fabric, as shown in FIG. 2.

In addition, the load-bearing portion 3 may include second protuberances 32. The second protuberances 32 are preferably of the same type as the protuberances 22 and perform substantially the same function.

In fact, preferably, the second protuberances 32 are housed inside the tubular element 40 and the latter is thus configured to house them.

In addition, the load-bearing portion 3 includes connection means 33.

The connection means 33 are preferably configured to lock the tubular element 40 in a predetermined position towards the ground, in which the stretcher 4 subjects the support surface 210 to continuous tension.

Appropriately, the connection means 33 are substantially interlocking means suitable to trap at least part of the stretcher 4 in such a way that it can remain permanently placed in a predetermined position, exercising its action in a continuous manner, as mentioned.

In detail, the stretcher 4 can also define a curvature, or concavity towards the ground. The latter can, in fact, facilitate the coupling between the connection means 33 maximising their stability given that the stretcher 4, once the user has sat on the support portion 2, exerts a force consistent with the locking direction of the connection means 33.

The support portion 2, and in particular the seat 21*b* and backrest 21*a*, is obtained mainly thanks to the stretcher 4. However, the configurations of the frame 20 and fabric 21 also contribute significantly to the technical aspects of the support portion 2, for example, thanks to the different rigidity that the fabric 21 can have, thanks in part to the shape of the frame 20.

As said, the production technique of the fabric 21, by means of machine knitting, allows the density and conformation of the fabric 21 to be controlled locally.

In addition, the shape of the frame 20 can allow, and preferably does allow, the fabric 21 to be subjected to different tensions along its perimetral area 211.

In particular, the frame 20 takes a preferably three-dimensional eight shape with the portion reserved for the seat 21*b* broader than the portion reserved for the backrest 21*a*.

In this way, a priori, the fabric 21 is tensioned more in the area reserved for the seat 21*b*. As a result, it is possible to synergistically combine the technological possibilities provided by the fabric 21, frame 20 and stretcher 4, so as to define a support surface 210 controlled in each sector.

For example, the seat 21*b* has a greater rigidity than the backrest 21*a* and therefore a lower deformability.

The operation of the chair 1 described above in structural terms is substantially defined by the procedure for its construction, described below.

The invention comprises, therefore, a new method of making a chair 1.

The procedure consists of a plurality of successive steps, that allow the chair 1 to be made from the individual parts. However, the most important step is the tensioning step. In fact, during the tensioning step, preferably the parts 200 are rotated reciprocally with respect to the rotation axes 2*a* in such a way as to create the frame 20 and tension the fabric 21.

This tensioning step is innovative in that it allows the support portion 2 to be made without any difficulty and guarantees the correct tensioning of the same in order to make the chair 1.

In addition, the tensioning step can be preceded by an installation step in which the fabric 21 is connected to the frame 20. In particular, preferably the slider(s) 212 of the surface 210 are inserted inside the guides 202 of the parts, for example through a specially cut slit at the ends of the parts 200, and the fabric 21 is then connected at the perimetral area 211 to the frame 20.

As previously mentioned, for example in a preferred embodiment where the production of the chair 1 is carried out by means of an ad hoc industrial machine, the tensioning step may be preceded by an assembly step.

In the assembly step, preferably, the parts 200, separate and distinct when not in the configuration of use, are juxtaposed and placed in contact at the aforementioned fixed points, preferably corresponding to the ends of the parts 200, in order to provide the hinges 201. For example, in this step, the parts are placed in contact in such a way as to define the rest configuration.

Once the hinges 201 have been defined, for example by coupling of assembly means such as protuberances, for example hooked, or pins, or otherwise, which allow the points of reciprocal rotation of the parts 200 to be defined, it is possible to carry out the tensioning step.

Interlocking assembly means as described above are known in the state of the art and are simple mechanical elements substantially functioning as shown in the FIGS. 14*a*-14*d*.

Aside from the above steps, the process includes other relevant steps that may complement or replace the previous step.

For example, a preferred manufacturing process of the chair 1, may include a support portion 2 defined in the tensioning step and possibly the installation step. Alternatively, the manufacturing process may include a support portion 2 including, initially, the frame 20 and the fabric 21 properly reciprocally connected with the tensioned fabric 21.

The procedure may then comprise a connection step in which the load-bearing portion 3 and the support portion 2 are mutually connected.

In particular, preferably, the connection step consists of inserting the protuberances 22 inside the holes 31 of the attachment means 30.

In addition, the process may advantageously include a further shaping step in which the stretcher 4 is connected to the support portion 2 and to the load-bearing portion 3 and tensions the surface 210.

More in detail, preferably, the tubular element 40 of the stretcher 4 is inserted inside the pocket 210*a* made on the surface 210 and is then connected by inserting the second protuberances 32 inside the ends of it.

Once the stretcher 4 is bound to both portions 2, 3 it is preferably juxtaposed to the ground and locked by the connection means 33 which allow the tubular element 40, and thus the stretcher 4, to be kept in a position such that the fabric 21 is tensioned in predetermined points, As a result, the shaping of the chair 1 allows the backrest 21*a* and the seat 21*b* of the chair 1 to be defined.

The chair 1 according to the invention achieves important advantages.

In fact, the chair 1 is easy to put together or assembled since each of the construction steps is greatly simplified. In particular, the tensioning step allows, by means of a mechanical or elastic mechanism, to tension the fabric 21 on the frame 20 in a controlled manner.

The addition of other elements such as the load-bearing portion 3 and the stretcher 4 is also very straightforward and not difficult for the user.

As a result of these advantages, a further advantage offered by the chair 1 is that it allows a quick supply of components if the chair 1 were to be marketed on a single order.

The simple production of the various components thanks to the technologies described, i.e. composite fibres, machine knitting, 3D controlled extrusion, allows each of the components to be obtained in a short time reducing, for example, inventory costs, for example, related to the maintenance of a warehouse, and the risks associated with large-scale production ahead of time.

In addition, a further advantage is that the chair 1 thus defined and made has a significant aesthetic value, the connection between fabric 21 and frame 20 being hidden and the shaping being carried out in a fully controlled manner. If the possible addition of a second guide 202 inside the frame 20 is considered, it is also possible to cover the part of the support portion 2 facing the ground, as well as the elements that connect the support portion 2 and the load-bearing portion 3.

In particular, the possibility of controlling the fabric 21 locally allows the creation of a 1 chair which, by virtue of the advantageous technical and aesthetic characteristics already expressed, is also comfortable and solid.

The easy assembly and disassembly of the chair 1 also has a considerable impact on aspects relating to the maintenance and recycling of the same or part of it. In fact, it is possible to quickly and easily change the fabric 21 in case of breakage or for aesthetic reasons, as well as other elements of the chair 1.

The interchangeability, combined with the speed of supply, are essential elements for chairs used in environments such as catering or offices and, in general, working environments.

The possibility of disassembling the various parts of the chair 1, separating the different materials, allows proper preparation of the materials for recycling, ensuring an excellent ecological disposal of the chair 1.

Variations may be made to the invention described herein without departing from the scope of the inventive concept defined in the claims.

For example, the system of connecting the fabric 21 and frame 20 may be different and may provide for a non-detachable connection between the two. In addition, the guide 202 could be suitable to house a number of adjacent sliders 212, as shown in FIG. 9*a*; therefore, the frame 20 could be operationally connected and joined to a plurality of fabrics 21, for example, overlapping.

In said sphere all the details may be replaced with equivalent elements and the materials, shapes and dimensions may be as desired.

The invention claimed is:

1. A modular chair comprising:

at least one support portion suitable to allow a user to sit on thereon and including a frame and a fabric, and said fabric defining a surface suitable to support said user and a perimetral area defined by the edges of said surface, said frame defining, in use, a closed profile and being suitable to support in tension said fabric along at least part of said perimetral area, wherein said frame comprises parts defining a configuration of use in which said parts make said frame and a configuration of rest in which said parts are folded together, and including a stretcher configured to tension said surface along predetermined fixed points in such a way that said fabric defines at least one backrest and one seat, said seat including a support surface subjected to greater tension than said backrest.

2. The modular chair according to claim 1, comprising a load-bearing portion suitable to support said at least one support portion suspended and permanently spaced from the ground and suitable for being detachably and stably connected to the support portion.

3. The modular chair according to claim 2, wherein said stretcher includes a U-shaped tubular element and said load-bearing portion includes connection means configured to lock said tubular element in a predetermined position towards the ground in which said stretcher subjects said surface to a continuous tension.

4. The modular chair according to claim 3, wherein said at least one support portion includes at least two second protuberances and said tubular element is configured to house at the ends each of said second protuberances.

5. The modular chair according to claim 3, wherein said support surface includes a pocket configured to accommodate at least part of the tubular element.

6. The modular chair according to claim 1, wherein said parts are separate and loosely connected to each other by means of two hinges, each part having a first end and a second end, the hinges arranged respectively at the ends of said parts to provide one said hinge between the first end of a first of the parts and the first end of a second of the parts, and to provide another said hinge between the second end of a first of the parts and the second end of a second of the parts, to define said configuration of use and said configuration of rest.

7. The modular chair according to claim 6, wherein said parts are two in one piece each, said hinges defines two mutually aligned respective axes of rotation, and said frame places said fabric in tension only when two said parts are opened passing from the configuration of rest to the configuration of use and when said two parts are in the configuration of use, said two parts being folded together like pages of a folded book in said configuration of rest.

8. The modular chair according to claim 1, wherein said frame consists of two of said parts.

9. The modular chair according to claim 1, wherein said frame defines a complex structure defined by a curve made along a trajectory that rotates around at least two main axes in three-dimensional space.

10. The modular chair according to claim 6, wherein each of said hinges includes interference portions mutually interfering only when said parts make said frame in the configuration of use and oriented in such a way that when said user is sitting on said surface said interference portions provide a mutual interference force proportional to the weight of said user, wherein the axes of rotation of the hinges are located such that when said user is sitting on said surface said interference portions are between the axes of rotation and the user.

11. The modular chair according to claim 1, wherein said frame defines at least one guide which is hollow and continuous at least along each of said parts and said fabric includes at least one slider placed along said perimetral area and suitable to be inserted inside said at least one guide, said at least one guide being configured to trap at least part of said at least one slider to connect said fabric and said frame to each other.

12. The modular chair according to claim 11, wherein said at least one guide is accessible only from the ground and said fabric is connected to said frame to wrap at least part of said frame.

13. The modular chair according to claim 8, wherein said two parts are mutually identical and mirror-like with respect to said axes of rotation.

14. The modular chair according to claim 1, wherein said load-bearing portion includes attachment means suitable to allow the detachable and permanent connection of said at least one support portion and said load-bearing portion.

15. The modular chair according to claim 1, wherein, when said parts are in a configuration unrelated to said rest and use configurations, are mutually distinct and separate and include protuberances or pins configured to define, when said two parts are brought into contact at least in said rest configuration, said hinges, suitable to reciprocally connect said two parts in said configuration of use.

16. A modular chair comprising:

at least one support portion suitable to allow a user to sit thereon and including a frame and a fabric, said fabric defining a surface suitable to support said user and a perimetral area defined by the edges of said surface, said frame defining, in use, a closed profile and being suitable to support in tension said fabric along at least part of said perimetral area, and wherein said frame comprises parts defining a configuration of use in which said parts make said frame and a configuration of rest in which said parts are folded together, including a load-bearing portion suitable to support said at least one support portion suspended and permanently spaced from the ground, wherein said load-bearing portion including attachment means suitable to allow the detachable and permanent connection of said at least one support portion and said load-bearing portion, wherein said frame includes protrusions protruding towards the ground and said attachment means define holes structurally configured to accommodate said protrusions to permanently block said at least one support portion onto said load-bearing portion.

17. The modular chair according to claim 16, comprising a stretcher configured to tension said surface along predetermined fixed points in such a way that said fabric defines at least one backrest and one seat, said seat including a support surface subjected to greater tension than said backrest.

18. The modular chair according to claim 17, wherein said stretcher includes a U-shaped tubular element and said load-bearing portion includes connection means configured to lock said tubular element in a predetermined position towards the ground in which said stretcher subjects said surface to a continuous tension.

19. The modular chair according to claim 18, wherein said at least one support portion includes at least two second protuberances and said tubular element is configured to house at the ends each of said second protuberances.

20. A method for making a chair, the chair comprising:

at least one support portion suitable to allow a user to sit thereon and including a frame and a fabric, and said fabric defining a surface suitable to support said user and a perimetral area defined by the edges of said surface, said frame defining, in use, a closed profile and being suitable to support in tension said fabric along at least part of said perimetral area, wherein said frame comprises parts defining a configuration of use in which said parts make said frame and a configuration of rest in which said parts are folded together, and including a stretcher configured to tension said surface along predetermined fixed points in such a way that said fabric defines at least one backrest and one seat, said seat including a support surface subjected to greater tension than said backrest; and the method comprising:

at least one tensioning step including folding said parts to create said frame and tension said fabric as a result of the opening movement of said parts which makes said frame passing from the configuration of rest to the configuration of use and when said parts are in the configuration of use, at least one shaping step including reciprocally connecting the stretcher to the support portion and to the load-bearing portion so that the stretcher tensions the surface.

21. A modular chair comprising:

at least one support portion suitable to allow a user to sit on thereon and including a frame and a fabric, and said fabric defining a surface suitable to support said user and a perimetral area defined by the edges of said surface, said frame defining, in use, a closed profile and being suitable to support in tension said fabric along at least part of said perimetral area, and a stretcher configured to tension said surface along predetermined fixed points in such a way that said fabric defines at least one backrest and one seat, said seat including a support surface subjected to greater tension than said backrest.

22. The modular chair according to claim 21, comprising a load-bearing portion suitable to support said at least one support portion suspended and permanently spaced from the ground and suitable for being detachably and stably connected to the support portion.

23. The modular chair according to claim 21, wherein said frame defines a complex structure defined by a curve made along a trajectory that rotates around at least two main axes in three-dimensional space.

24. A method for making a chair, the chair comprising:

at least one support portion suitable to allow a user to sit thereon and including a frame and a fabric, and said fabric defining a surface suitable to support said user and a perimetral area defined by the edges of said surface, said frame defining, in use, a closed profile and being suitable to support in tension said fabric along at least part of said perimetral area, and including a stretcher configured to tension said surface along predetermined fixed points in such a way that said fabric defines at least one backrest and one seat, said seat including a support surface subjected to greater tension than said backrest;

and the method comprising:

at least one shaping step including reciprocally connecting the stretcher to the support portion and to the load-bearing portion so that the stretcher tensions the surface.

* * * * *